US006366152B1

(12) United States Patent
Takeuchi et al.

(10) Patent No.: US 6,366,152 B1
(45) Date of Patent: Apr. 2, 2002

(54) VECTOR-SIGNAL PROCESSING CIRCUIT

(75) Inventors: Yukihisa Takeuchi, Aichi-ken; Kazuyoshi Shibata, Mizunami; Iwao Ohwada, Nagoya; Masahiko Namerikawa, Seto, all of (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/664,649

(22) Filed: Sep. 19, 2000

(30) Foreign Application Priority Data

Oct. 15, 1999 (JP) ..... 11-294191

(51) Int. Cl.[7] ..... G06G 7/25
(52) U.S. Cl. ..... 327/354; 327/343
(58) Field of Search ..... 327/354, 588, 327/494, 495, 496, 104, 184, 339, 343, 361; 307/127

(56) References Cited

U.S. PATENT DOCUMENTS 3,652,946 A * 3/1972 Acker ..... 329/366
3,911,291 A * 10/1975 Rossell ..... 327/104
4,459,493 A * 7/1984 Moore ..... 307/127
4,518,877 A * 5/1985 Hearn et al. ..... 327/113
4,899,064 A * 2/1990 Neidorff ..... 327/354
5,127,401 A * 7/1992 Grevious et al. ..... 128/429
5,305,243 A * 4/1994 Ayraud et al. ..... 708/5
5,394,107 A * 2/1995 Shou et al. ..... 327/354
5,642,070 A * 6/1997 Furukawa ..... 327/354
5,703,518 A * 12/1997 Yamamoto ..... 327/354

* cited by examiner

*Primary Examiner*—Kenneth B. Wells
*Assistant Examiner*—Hai L. Nguyen
(74) *Attorney, Agent, or Firm*—Burr & Brown

(57) ABSTRACT

A vector-signal processing circuit can be operated with low power consumption and can be configured so as to be cheap. Sensor signals in three-axial directions are individually rectified by full-wave-rectifier circuits individually formed by combining four diodes. Subsequently, the outputs of the above are added by an adder circuit and are further processed by a comparator, thereby generating digital signals. Forward-voltage-falling characteristics of the individual diodes used in the full-wave rectifier circuits are set to 0.3 V, and a threshold of the comparator is set to 0.6 V.

2 Claims, 3 Drawing Sheets

VECTOR-SIGNAL PROCESSING CIRCUIT

BACKGROUND OF THE INVENTION

1. Field of the Invention

The present invention relates to a vector-signal processing circuit for converting vector signals composed of a plurality of analog signals to absolute values, there by processing the vector signals.

2. Related Art

Conventionally, the following three methods are generally known as methods for converting vector signals individually formed of very small analog signals of sensors, transducers, and the like to absolute values, thereby generating digital signals of TTL and the like corresponding to input signals of, for example, microcomputers:

(a) a method that amplifies the signals by using operational amplifiers, then performs analog-digital conversion for the amplified signals, and then converts the conversion outputs to absolute values by using a microcomputer, thereby generating digital signals;

(b) a method that amplifies the signals by using operational amplifiers, and then generates digital signals by using a microcomputer having analog-digital-conversion inputs; and (c) a method that amplifies the signals by using operational amplifiers, then processes the outputs in absolute-value circuits that use ideal diodes and that are formed of two operational amplifiers, and then performs digital conversion for the outputs by using a comparator, thereby generating digital signals.

Gas meters for a city gas, for example, contain a seismoscope that functions to prevent gas leakage in the case of an earthquake. They also contain a system in which, in the case of an earthquake, an acceleration sensor senses the quake, and a valve is automatically shut. However, difficulty arises in securing the power supply for driving electrical circuits provided in such outdoor-use apparatuses as gas meters. Because of this difficulty, most of such apparatuses are configured so as to contain a battery for driving electric circuits. Therefore, techniques are being developed so that power consumption for use of these apparatuses is reduced as much as possible, and service life of the battery is increased as long as possible.

From these viewpoints, the above-described three methods have problems. Methods (a) and (b) require analog-digital converters and/or microcomputers, and method (c) requires many operational amplifiers. Therefore, any one of the methods requires a relatively high consumption current, for example, 10 $\mu$A, which inhibits further reduction in power consumption.

For example, to perform an operation according to method (c), each of the absolute-value circuits using the ideal diodes requires two operational amplifiers. It also requires an adder circuit to be provided upstream of the comparator. Thus, method (c) uses many operational amplifiers.

Ordinarily, to perform high-accuracy detection of the acceleration rate from outputs of an acceleration sensor, analog signals, which are individual sensor signals in the three axial directions (that is, components of an acceleration vector decomposed in the three axial directions) are subjected to square-mean operations, and absolute values of vectors are thereby obtained. To obtain the absolute values, at least two operational amplifiers are required for a squaring operation; therefore, at least six operational amplifiers are required for the operations for the three axial directions. In addition, operational amplifiers are also required for square-root operations. Therefore, with operational amplifiers for amplifying the sensor signals being included, totally, at least ten operational amplifiers are required. The need for so many operational amplifiers requires a circuit that has a complicated and expensive configuration that increases power consumption.

Under these circumstances, there is a demand for a cheap circuit capable of converting analog signals to absolute values, thereby generating digital signals of TTL and the like with a small amount of power consumption.

SUMMARY OF THE INVENTION

In view of the above-described problems, an object of the present invention is to provide a vector-signal processing circuit that allows power consumption to be reduced, and in addition, that allows configuration to be performed at low costs.

As shown in FIG. 2, even when current is allowed to pass forward, a diode causes a forward-voltage fall $V_f$, for example, in a range of 0.3 V to 0.5 V. Making use of this characteristic, the inventor exerted efforts to solve the above-described problems. As a result, it was found that digital-voltage-output signals of TTL and the like, which are equivalent to the square mean value, can be obtained by using diode bridges in full-wave-rectifier circuits, simply by selecting a combination of the forward-voltage fall and a reference voltage used as a threshold for comparison of a comparator, and by performing simple-addition of absolute values of the signals in the three axial directions.

To these ends, according to the present invention, there is provided a vector-signal processing circuit comprising a plurality of full-wave-rectifier circuits for individually rectifying analog signals made of at least two axial components of a vector signal, which are perpendicular to each other. It also comprises an adder circuit for adding outputs of the plurality of full-wave-rectifier circuits, and a comparator for converting outputs of the adder circuit. Each of the full-wave-rectifier circuits is composed of a diode bridge formed of diodes each having specific forward-voltage-falling characteristics, thereby converting the signals processed by the adder circuit to pseudo-absolute-value signals of the vector signal.

In the above an arrangement may be such that the analog signals are three axial components, the forward-voltage fall amount of the diode of three diode-bridge full-wave-rectifier circuits for rectifying the analog signals is substantially 0.3 V, and a threshold of the comparator is substantially 0.6 V.

According to the present invention summarized above, absolute-value outputs of the vector signal composed of very small analog signals in the three axial directions can be generated by using the circuit that can be operated with low power consumption and that can be produced cheaply. The absolute-value outputs can be generated by selection of forward-voltage-falling characteristics of the diodes that form the rectifier circuits, for example, by using only four operational amplifiers, without using an analog-digital converter or a microcomputer.

DESCRIPTION OF THE PREFERRED EMBODIMENTS

Hereinbelow, referring to the accompanying drawings, a detailed description will be given of an embodiment of the present invention.

Figure 1:
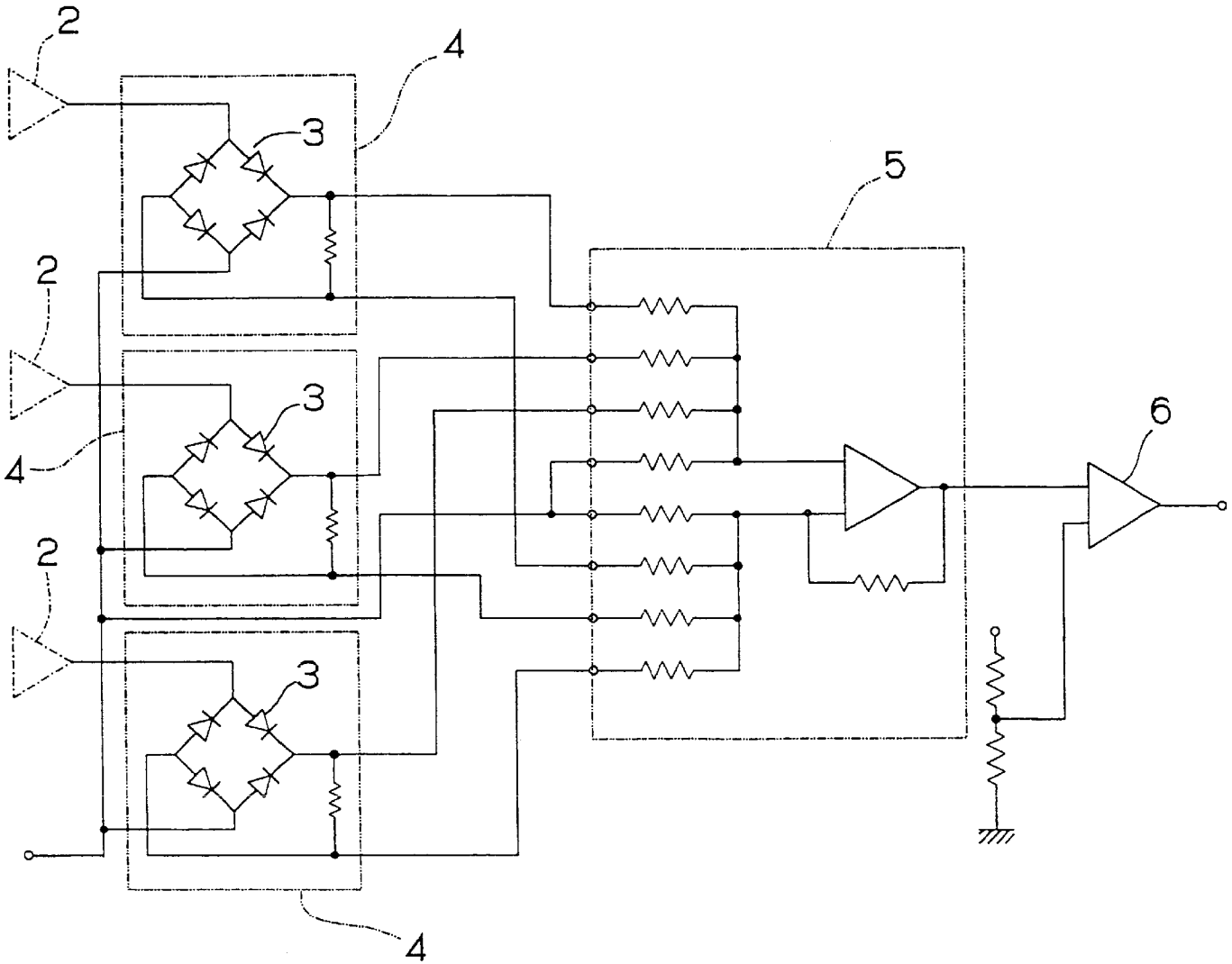
FIG. 1 is a circuit diagram of a vector-signal processing circuit according to an embodiment of the present invention.
Figure 2:
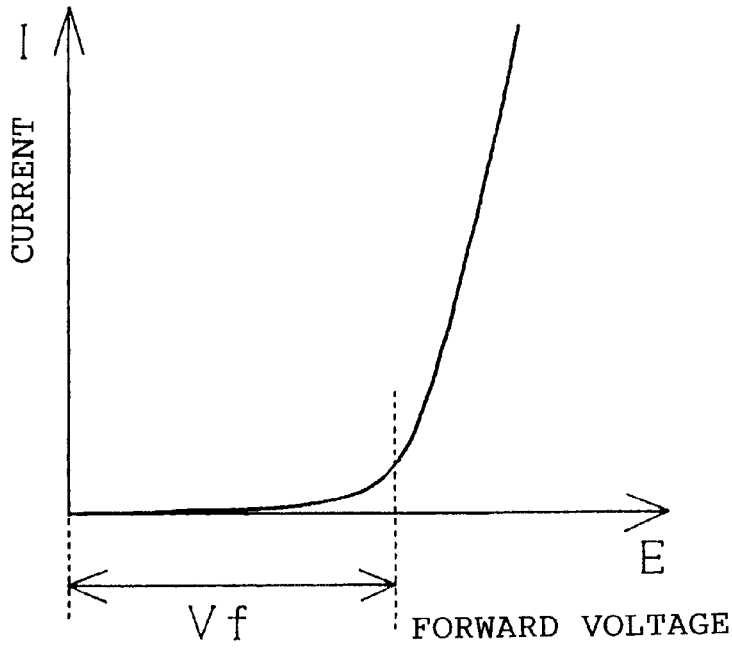
FIG. 2 is a graph showing forward-direction characteristics of a diode.

FIG. 1 is a circuit diagram of a vector-signal processing circuit. In the circuit, there are inputted analog output signals in the directions of the three axes x, y, and z, which are produced by, for example, publicly known acceleration sensors. The publicly known sensors include, for example, an acceleration sensor disclosed in Japanese Unexamined Patent Application Publication No. 5-26744. The disclosed sensor uses piezoelectric elements and outputs sensor signals in the three axial directions.

In the circuit of the embodiment, the inputted analog output signals are individually amplified in amplifier circuits 2. The amplified signals are individually rectified for the full wave in full-wave-rectifier circuits 4 each comprising a diode bridge 3 that is composed of an assembly of four diodes. Subsequently, the rectified signals are simple-added in an adder circuit 5, and the outputs therefrom are converted to H or L signals, that is, digital signals of TTL and the like, by a comparator 6.

Figure 3:
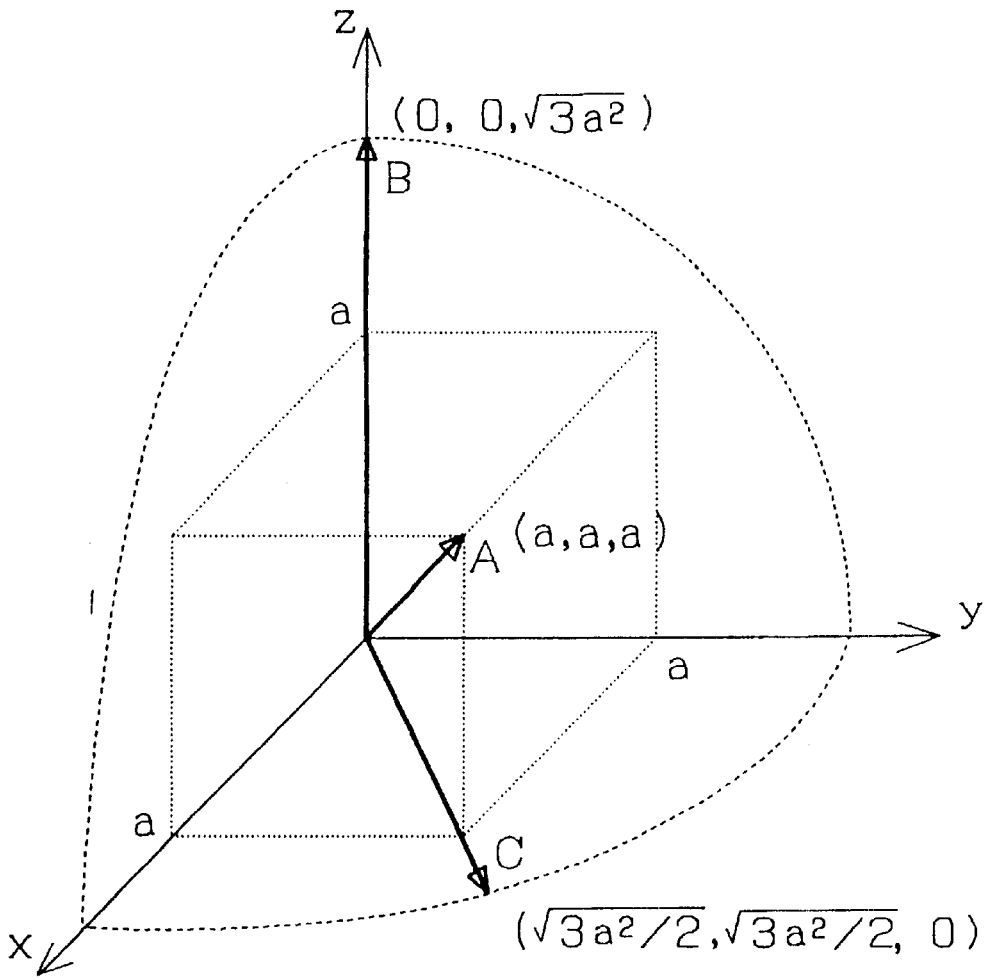
FIG. 3 is illustrative of a vector decomposed in three axial directions.

In the described circuit of the embodiment, for example, suppose a diode having forward-voltage-falling characteristics of 0.3 V is selected for each of the diodes used in the full-wave-rectifier circuits 4. In this case, if a signal of 0.5 V is inputted to the circuit, the voltage is supposed to fall to 0.2 V as a result of passing through the rectifier circuit 4. Such being the case, for three directions A, B, and C that are shown in FIG. 3, for example, when absolute-value operations for vectors having the same absolute value 0.87 V (when a=0.5, the absolute value of the vectors of the three axes is the square root of $a^2+a^2+a^2$, therefore resulting in 0.87) are performed using the circuit of the embodiment, components of the individual directions are as follows:

A direction x, y, z=0.5, 0.5, 0.5

B direction x, y, z=0, 0, 0.87

C direction x, y, z=0.61, 0.61, 0

After the signals are passed through the rectifier circuit, the individual components are found to have the following values:

A direction x, y, z=0.20, 0.20, 0.20

B direction x, y, z=0, 0, 0.57

C direction x, y, z=0.31, 0.31, 0

Furthermore, after the signals are passed through the adder circuit 5, the individual components are found to have the following values:

A direction=0.60

B direction=0.57

C direction=0.62

As can be seen from the above, without the square mean being obtained for the individual directions, the variation in the absolute values of the three directions can be maintained within about 10%.

This means that, when the variation in their absolute values exceed a predetermined value, detection can be performed for the vectors in any directions within an error range of about 10%.

Accordingly, according to the embodiment, setting the threshold of the comparator 6 to, for example, 0.6 V, allows a similar threshold to be provided for any direction. That is, a pseudo-absolute-value detecting circuit for vectors can be formed by using a full-wave-rectifier circuit formed of diodes each having forward-voltage-falling characteristics of 0.3 V.

Thus, the absolute-value out puts of the vector signal formed of the analog signals, which are very small, in the three axial directions can be generated by selection of the forward-voltage-falling characteristics of the diodes that form the rectifier circuit, for example, by use of only one additional operational amplifier in the adder circuit. That is, the aforementioned absolute-value outputs can be generated without using an analog/digital converter (A/D converter) nor a microcomputer, but with relatively low power consumption and with a relatively cheap circuit comprising only four operational amplifiers even including the aforementioned operational amplifier and other operational amplifiers used for amplifying the individual analog signals.

In addition, since the threshold of about 0.6 V can be set for the comparator 6, the above-described circuit of the embodiment can suitably be used in a sensor-signal detecting circuit drivable using a voltage in a range of 2.2 V to 3.0 V. That is, the circuit can suitably be used for a sensor-signal detecting circuit drivable using battery power.

As above, while the present invention has been described referring to the specific embodiment, it is to be understood that the invention is not restricted thereto. On the contrary, the invention is intended to cover various other modifications and equivalent arrangements within the spirit and scope of the invention.

What is claimed is:

1. A vector-signal processing circuit comprising:

three full-wave-rectifier circuits for individually rectifying analog signals made of three axial components of an input vector signal which are perpendicular to each other;

an adder circuit for adding outputs of said plurality of full-wave-rectifier circuits; and a comparator for converting outputs of said adder circuit;

wherein each of said full-wave-rectifier circuits is composed of a diode bridge formed of diodes each having a predetermined forward-voltage-falling amount, and a threshold of said comparator and a level of said input vector signal are selected based on said predetermined forward-voltage-falling amount, whereby the signals processed by said adder circuit can be converted to pseudo-absolute-value signals of the input vector signal.

2. A vector-signal processing circuit as claimed in claim 1, wherein said forward-voltage falling amount is substantially 0.3 V, and said threshold of said comparator is substantially 0.6 V.

* * * * *